US006386469B1

(12) United States Patent
Meister et al.

(10) Patent No.: US 6,386,469 B1
(45) Date of Patent: May 14, 2002

(54) GRANULATING DEVICE WITH A CUTTING ROTOR

(75) Inventors: Peter Meister, Aschaffenburg; Juergen Seifert, Elsenfeld, both of (DE)

(73) Assignee: Rieter Automatik GmbH (DE)

( * ) Notice: Subject to any disclaimer, the term of this patent is extended or adjusted under 35 U.S.C. 154(b) by 0 days.

(21) Appl. No.: 09/601,452

(22) PCT Filed: Sep. 7, 1999

(86) PCT No.: PCT/EP99/06572

§ 371 Date: Sep. 21, 2000

§ 102(e) Date: Sep. 21, 2000

(87) PCT Pub. No.: WO00/32367

PCT Pub. Date: Jun. 8, 2000

(30) Foreign Application Priority Data

Dec. 2, 1998 (DE) ..... 198 55 617

(51) Int. Cl.[7] ..... B02C 18/18
(52) U.S. Cl. ..... 241/294
(58) Field of Search ..... 241/294, 242

(56) References Cited

U.S. PATENT DOCUMENTS 2,652,749 A * 9/1953 Hagmeister ..... 241/294
3,887,975 A 6/1975 Sorice et al.
5,042,733 A 8/1991 Hench

FOREIGN PATENT DOCUMENTS

| | | | |
|---|---|---|---|
| DE | 3319799 | 12/1984 | |
| DE | 3736269 | * 9/1989 | ..... 241/294 |
| EP | 0182037 | 5/1986 | |
| EP | 0357549 | 3/1990 | |
| FR | 2131650 | 11/1972 | |

* cited by examiner

*Primary Examiner*—Mark Rosenbaum
(74) *Attorney, Agent, or Firm*—Banner & Witcoff, Ltd.

(57) ABSTRACT

Pelletizing device for cutting plastic fiber strands into pellets, having a strand-feeding device and a cutting rotor, which is driven by a drive system and has cutting blades distributed over its rotor circumference, the root areas of which blades are arranged in grooves in the rotor body, each cutting blade having at least one recess parallel to the cutting edge, which recess is covered by the groove and interacts with a clamping element which is supported against the rotor body, in which device the clamping element is a slotted clamping sleeve, the cylindrical outer contour of which is of the same shape as the recess in the cutting blade.

8 Claims, 5 Drawing Sheets

GRANULATING DEVICE WITH A CUTTING ROTOR

Figure 1:
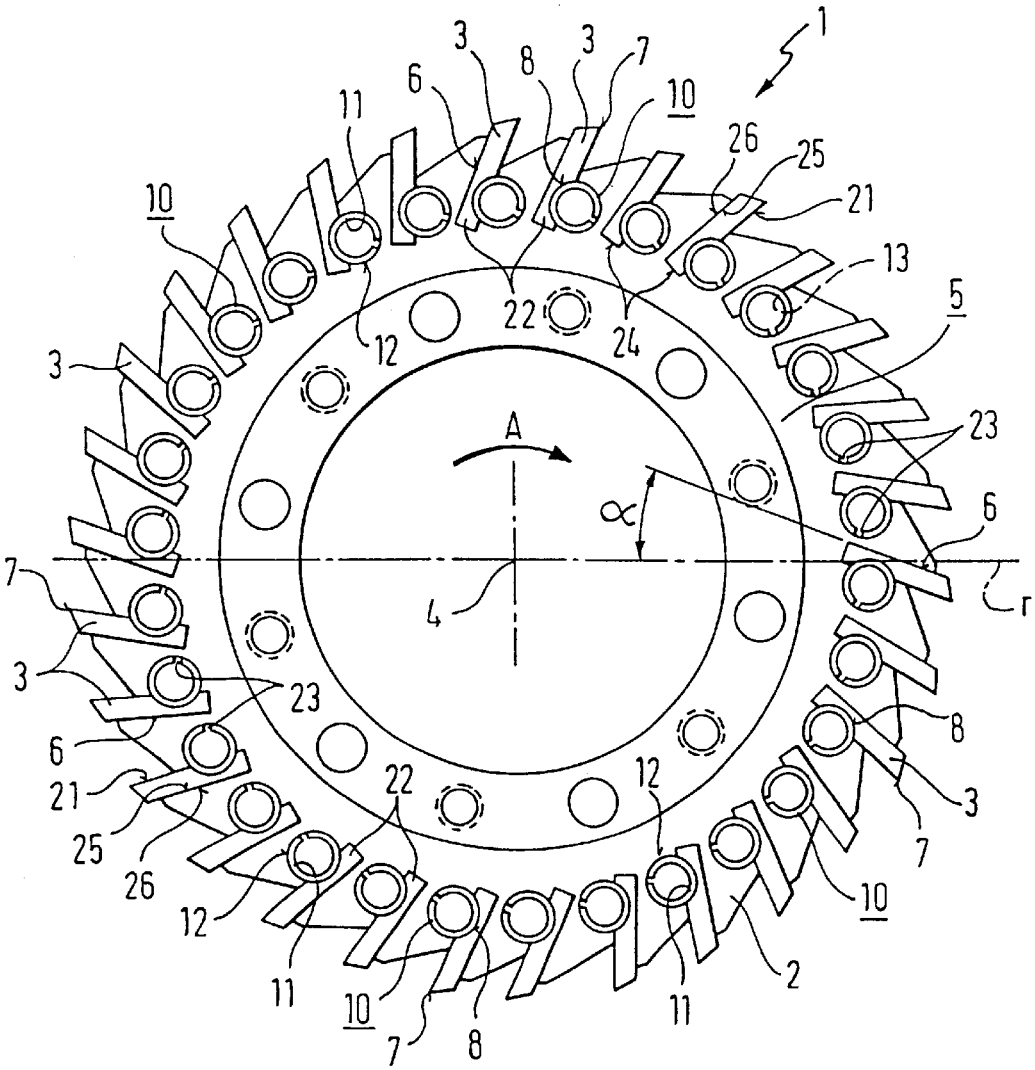

Pelletizing device for cutting plastic fibre strands into pellets, having a strand-feeding device and a cutting rotor, according to the preamble of claim 1.

Pelletizing devices of this nature are used in strand-pelletizing installations, in which a plastic material in the molten state is extruded from dies to form strands, which are initially cooled in a feed channel until their surface is no longer sticky and are then fed to a pelletizing device by means of a strand-feeding device. A cylindrical cutting rotor, which is equipped with cutting blades on its circumferential surface and cuts the plastic fibre strands into pellets, rotates at a high speed in the pelletizing device. Pellets of this nature can then be provided in the form of plastic granules for further processing steps.

For this reason, the cutting rotor, together with its blades, forms the principal component of a pelletizing device of this nature. These blades are distributed over the circumference of the rotor and can be clamped with their root regions in grooves in the rotor body by mechanical, pneumatic, hydro-mechanical or electromechanical means. Naturally, it is also conceivable to use cutting rotors in which blades, which are preferably made from sintered carbide, are soldered into the grooves of the rotor body, but solutions of this nature have the drawback that the blades cannot be exchanged without considerable effort.

The publication EP 0,357,549 A1 has disclosed a cutting rotor with blades which are clamped in grooves in a rotor body, the blades having at least one concave clamping surface, against which a conical screw bears, the axis of which is parallel to the longitudinal direction of the blade, the cone of the conical screw bearing eccentrically against the clamping surface. This known solution provides two conical screws which are clamped against one another for one blade, one conical screw securing the blade from one edge of the blade in the axial direction, and the second conical screw securing the blade from the opposite edge thereof. In this way, the blade is fixed and preloaded in the axial direction on the rotor circumference.

This known solution has the drawback that pressure is exerted on the blade from both sides, and thus the blade can be bent or distorted adversely in the tolerance range of the groove in the rotor body. This, on the one hand, entails the drawback of geometric inaccuracy and, on the other hand, may also cause unforeseen imbalance.

A further drawback of the axial clamping in the known solution is that the conical screws are subjected to tensile loads at their critical transition from the cone to the screw thread, so that the notching effect of the transition from the screw thread to the cone may cause the entire cone, together with the screw head, to tear off due to notch cracking. In the event of such damage, for example, the carbide cutter is no longer held in place by anything, since only the screw thread of the conical screw remains in the rotor body, so that, for example, the sintered carbide blade is thrown out of the groove by the centrifugal force of the rotor, thus endangering the entire pelletizing device. To avoid notch fractures of this nature, the conical screw has to be oversized and subjected to special machining steps during its manufacture, in order to minimize the notching effect at the transition from the screw thread to the conical area. Furthermore, a complete threaded hole has to be incorporated in the material of the rotor body, in order to ensure that the conical screws can be clamped securely in place. A large amount of the rotor-body material is also required for these holes, resulting in the further disadvantage that it is impossible to distribute as many as blades as required over the rotor circumference, since this mechanical form of attachment using conical screws requires a considerable volume between two blades.

The object of the invention is to provide a pelletizing device according to the preamble of claim 1 which overcomes the drawbacks of the prior art and, in particular, results in a cutting rotor which allows the maximum possible number of cutting blades to be positioned on the rotor circumference and reduces the risk of a cutting blade being thrown out, as well as avoiding distortion of the blades.

This object is achieved by means of the features of the present invention.

To this end, there is provision for the pelletizing device for cutting plastic fibre strands into pellets to be equipped with a strand-feeding device and a cutting rotor, which is rotated by a drive system and provides cutting blades distributed over its circumference. The cutting blades are positioned in grooves. Parallel to its cutting edge, each cutting blade has at least one recess which, in the installed state, is covered by the groove. A clamping element which is supported against the rotor body engages into the recess in the cutting blade and ensures that the cutting blade is held in position. According to the invention, the clamping element comprises a slotted clamping sleeve, the cylindrical outer contour of which is of the same shape as the recess in the cutting blade.

The solution according to the invention has the advantage of using a thread-free clamping element in order to hold the blade in position on the rotor circumference. The smooth surface of the slotted clamping sleeve is not exposed to any notching effects whatsoever. Since the cutting blades are subjected to essentially centrifugal forces, they can be held securely by the clamping sleeves, which engage in a form-fitting manner into the recess in the cutting blades.

The preloading of the slotted clamping sleeves makes it possible to compensate for the slight axial forces which could cause axial displacement of the blades by means of the force-fitting connection between the preloaded, slotted clamping sleeve and the cutters. Thus, the solution according to the invention ensures that it is impossible for the blades either to be displaced in the axial direction or to break out in the radial direction. In this solution, there is no possibility whatsoever of a conical extension breaking off from a threaded area of a conical screw.

Prior to installation, the diameter of the unclamped, slotted clamping sleeve is greater than the diameter of the recesses which are provided in the rotor body and on the cutter surface, parallel to the cutter edge, for a clamping sleeve of this nature.

Preferably, a clamping sleeve of this nature may extend over the entire width b of a blade. For this purpose, a corresponding recess is to be provided over the entire width b of a blade. However, it is also possible to provide recesses on each side of the blade, which recesses engage with two corresponding clamping sleeves which are supported against the rotor body.

A continuous clamping sleeve has the advantage that it can be fitted and removed easily by being pressed in the axial direction into the recesses provided in the rotor body and in the blade and due to the fact that it can be pressed out with the aid of a mandrel in the event of removal being necessary. In the case of recesses which do not extend over the entire width, two clamping sleeves are required on either side. For these clamping sleeves to be removed, they preferably have an internal screw thread into which withdrawal means can be screwed.

In a preferred embodiment, the recess in the cutting blade and an opposite recess in the rotor body together form a cross section with segments of a circle which are offset with respect to one another. This offset of the circle-segment cross sections of the recesses with respect to one another is minimal and ensures that there is not only a clamping action in the tangential direction on the cutting blade from the clamping sleeve, but also a radial component pressing the blade onto the rotor. For this purpose, the circle-segment cross section of the recess in the cutting blade is preferably offset radially outwards with respect to the circle-segment cross section of the recess in the rotor body. An offset in this direction causes the clamping sleeve to press the blade radially into the groove of the rotor body, so that it is impossible for there to be any play between the base of the groove and the cutting blade.

The clamping sleeve is preferably made from spring steel, in order to provide the necessary preloading by deformation.

In a preferred embodiment of the invention, the clamping sleeve has an internal screw thread which extends inwards from the outer edge of the clamping sleeve and merges into a smooth, inwardly tapering inner cone in the end region of the clamping sleeve. On the one hand, the internal screw thread makes a clamping sleeve of this nature easy to remove, and on the other hand the clamping sleeve, due to a smooth, inwardly tapering inner cone, has a greater spring action in the inner area than in the outer area.

In a further preferred embodiment of the invention, the inner cone of the clamping sleeve, by the insertion of a grub screw, can be brought into engagement with an attached cone. In this case, the grub screw, in the area of the inner cone of the slotted clamping sleeve, will widen the latter in the segmental direction with respect to the cutting rotor, towards the recess in the cutting blade. The widening of the clamping sleeve, when the grub screw is screwed in, connects the cutting blade to the rotor body in a form-fitting and force-fitting manner by means of the clamping sleeve.

In contrast to the prior art cited above, the grub screw does not have to be oversized, but rather can be kept as small as possible, since the transition between the inner cone of the grub screw and the screw thread of the grub screw is not subjected to tensile loads, but rather to compressive loads. This makes notch fractures virtually impossible. Even if a notch fracture of this nature were to occur, the cone, which presses the clamping sleeve against the recess in the cutting blade, could not pop out, as happens in the prior art, and thus release the cutting blade, but rather remains in the inner area of the clamping sleeve and is held in place by the threaded area of the grub screw. A grub screw can be screwed into and out of a clamping sleeve of this nature by means of a hexagon socket in the threaded area of the grub screw.

In a further preferred embodiment of the invention, the clamping sleeve has an internal screw thread which tapers conically inwards from the outer edge of the clamping sleeve. A simple cylindrical grub screw can be accommodated by the screw thread and, when screwed into the clamping sleeve, widens the latter in the segmental direction with respect to the cutting rotor, towards the recess in the cutting blade. The cutting blade is then connected to the rotor body in a form-fitting and force-fitting manner by means of the clamping sleeve, the form fit acting essentially in the radial direction, and the force fit prevails in the axial direction.

This solution has the advantage that only the slotted clamping sleeve has to have a tapering internal screw thread, while a cylindrical, standardized grub screw can be used for prestressing of the clamping sleeve. A further advantage of this solution is that in this case too the grub screw can be subjected to entirely compressive loads, so that there is virtually no possibility of a notch fracture in the area of the screw thread.

Preferably, an eccentric extension is arranged on the inner end of the clamping sleeve. This eccentric extension may be designed as a cylindrical elongation which is parallel and offset with respect to the axis of the clamping sleeve. When the cutting blades are being fitted into the cutting rotor, the eccentric extension advantageously prevents the clamping sleeve from turning, so that the grub screw can be screwed reliably into the clamping sleeve during assembly. To this end, the eccentric extension is advantageously supported on that area of the cutting blade which is free from the recess or is advantageously in engagement with a correspondingly offset hole in the rotor body as an extension of the recess 12 in the rotor body.

A preferred material for the clamping sleeve is spring bronze. This material is not only highly elastic, in the same manner as spring steel, but also allows limited plastic deformation, so that the spring bronze can be adapted more easily to shifts and offsets in cross section between the recess in the cutting blade and the recess in the rotor body.

Preferably, the cutting blades, with their root area in the grooves, are arranged in the rotor body with a uniform distribution on the rotor circumference, at an acute angle, in the axial direction, of less than 10 degrees, preferably between 3 and 6 degrees, with respect to the rotor axis of the cutting rotor. This arrangement has the advantage that the pellets are not knocked off the plastic fibre strands, but rather can be cut off, in the pelletizing device.

In a preferred embodiment of the invention, the recess in the cutting blade is formed on the cutting-edge side. With this preferred arrangement of the recess, the cutting blade is pressed, by the clamping element, i.e. the clamping sleeve, onto that surface of the groove in the rotor body which is opposite the cutting edge. In this way, the blade is supported over a large area by the rear wall of the groove, since the clamping element presses the entire surface of the blade against the rear wall of the groove. Naturally, the clamping element and the recess may be made on the other side, which lies opposite the cutting edge, but in this case the bearing surfaces are considerably reduced in size, so that tilting moments may act on the cutting blade in the groove.

Figure 2:
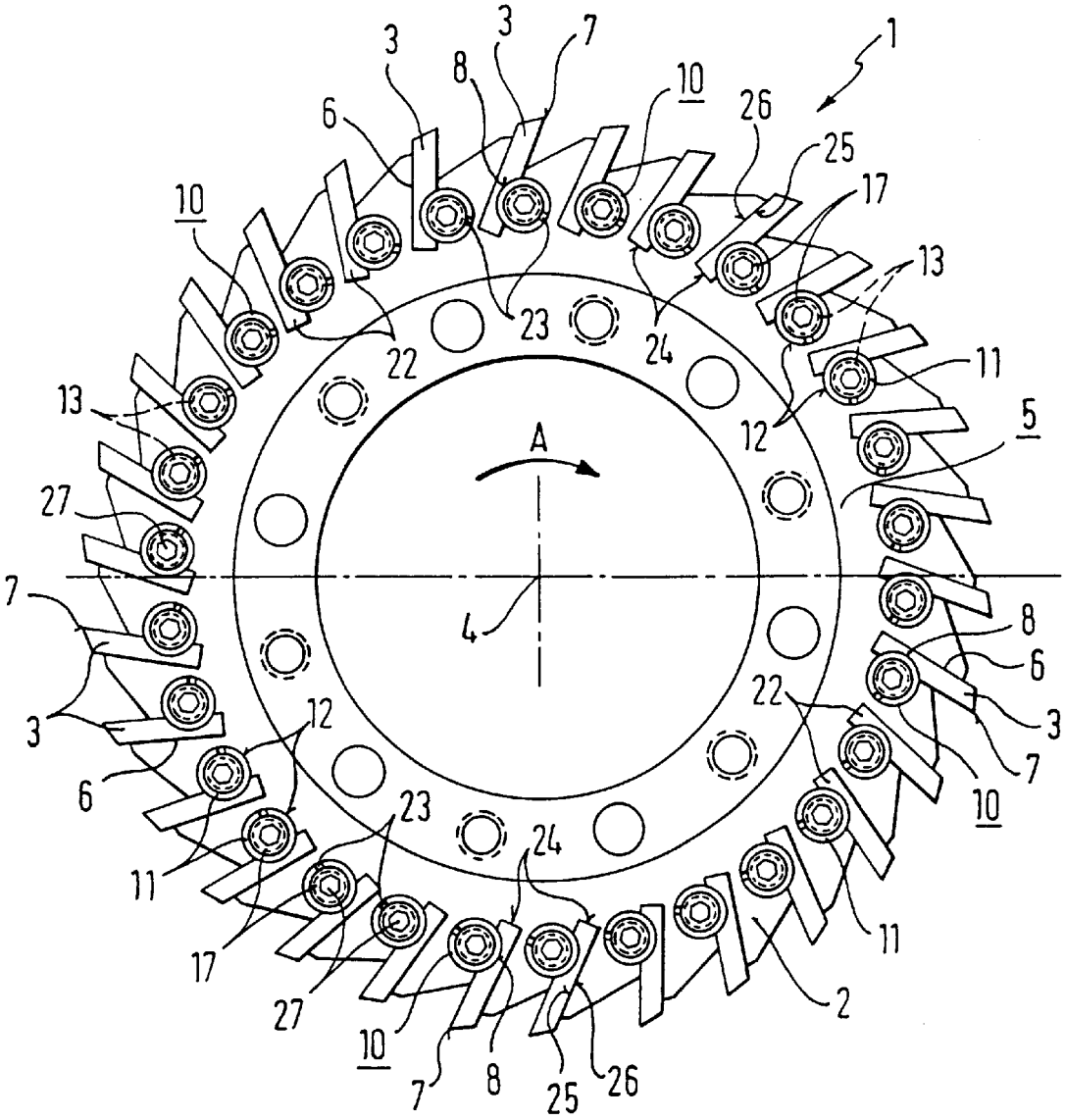
Figure 3:
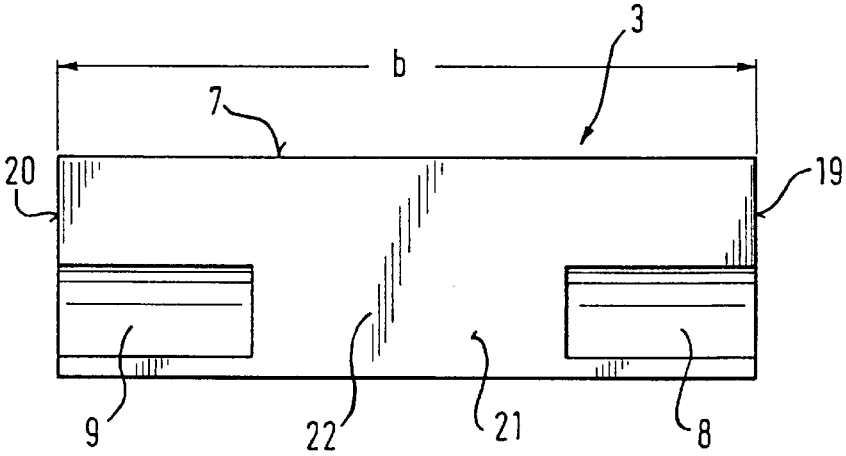
Figure 4:
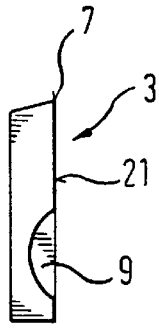
Figure 5:
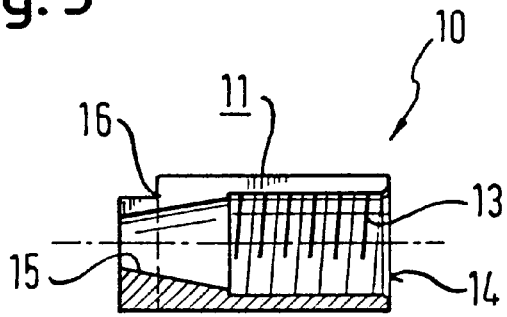
Figure 6:
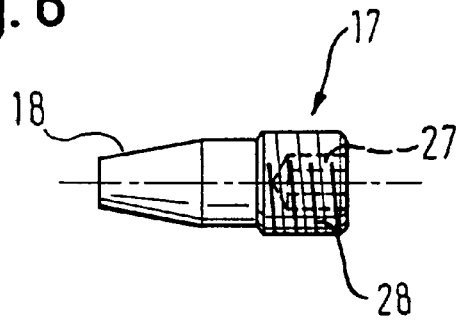
Figure 7:
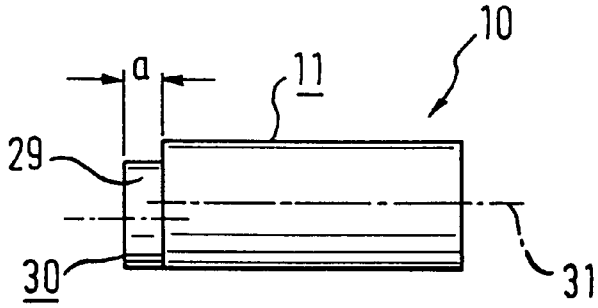
Figure 8:
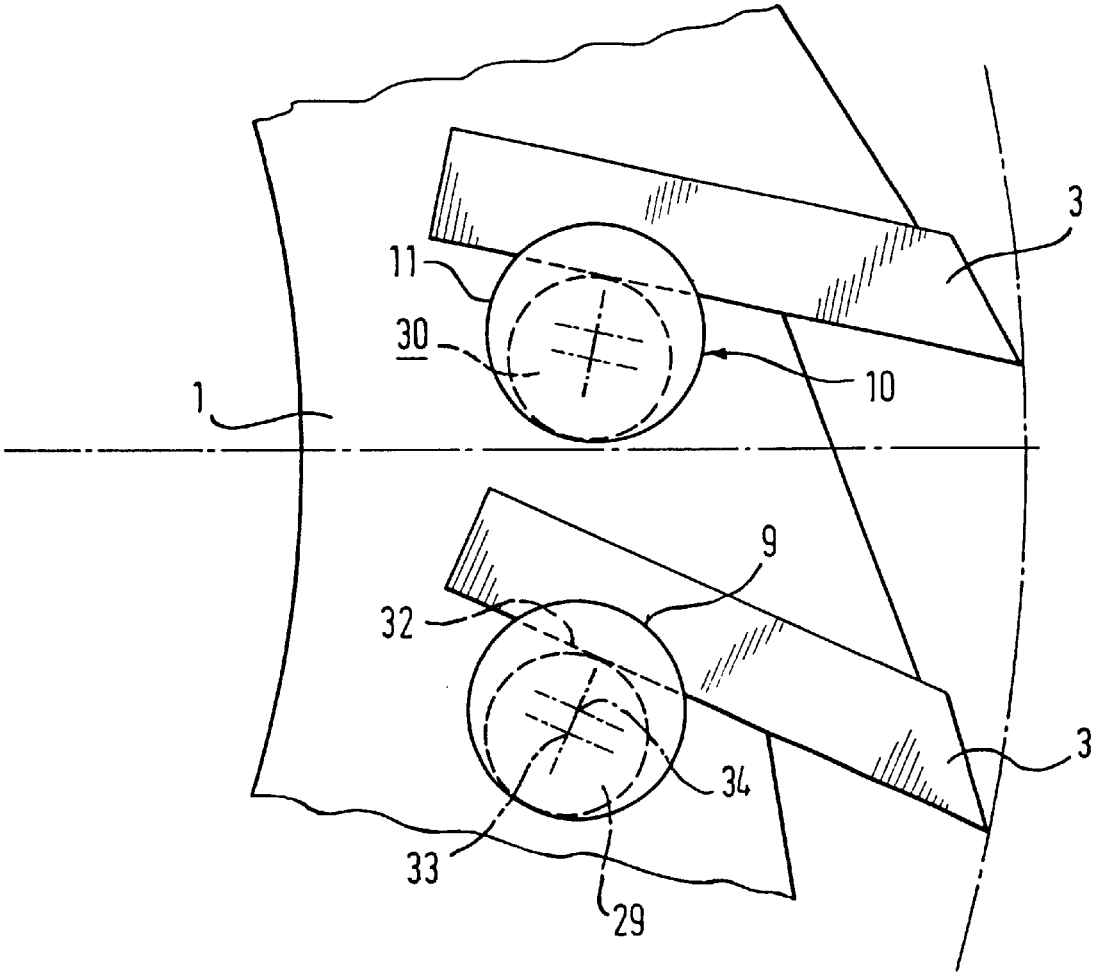

Further advantages, features and possible applications of the invention will now be explained in more detail on the basis of an exemplary embodiment and with reference to the appended drawings, in which:

FIG. 1 shows an outline sketch of a cutting rotor of a pelletizing device, in a first preferred embodiment of the invention, FIG. 2 shows an outline sketch of a cutting rotor of a pelletizing device, in a second preferred embodiment of the invention, FIG. 3 shows a view of a blade of a pelletizing device, in one embodiment of the invention, FIG. 4 shows a side view of a blade from FIG. 3, FIG. 5 shows a cross section through a slotted clamping sleeve, in one embodiment of the invention, and FIG. 6 shows an outline sketch of a grub screw of a pelletizing device, in one embodiment of the invention, FIG. 7 shows a side view of a clamping element with a device for blocking rotation, FIG. 8 shows an enlarged section of a cutting rotor with fitted clamping element and with a device for blocking rotation.

FIG. 1 shows an outline sketch of a cutting rotor 1 as used in a pelletizing device in a first preferred embodiment of the invention.

The cutting rotor has a rotor body 5 which, on its circumferential surface 2, bears cutting blades 3, preferably made from sintered carbide plates. The sintered carbide plates have a cutting edge 7 which projects out of the rotor circumference. A root region 22 of each cutting plate fits into a groove 6 which is formed parallel to the rotor axis 4, in the rotor body 5, starting from the rotor circumferential surface 2. The groove 6 has an acute setting angle a with respect to the radial direction r of the cutting rotor 1, so that the cutting blade is able to adopt an identical setting angle as soon as it is fixed in the groove.

In this embodiment shown in FIG. 1, recesses which extend parallel to the cutting edge 7 are provided in the root area 22 of the cutting blades 3, in order to fix the cutting blade in the groove. A clamping element 10, which is supported against the rotor body 5 and, in this preferred embodiment of the invention, is formed by a clamping sleeve 11 with slot 23, engages in these recesses. To this end, the cylindrical outer contour of the clamping sleeve 11 is of the same shape as the recess 8 in the cutting blade 3.

In the embodiment shown in FIG. 1, a recess 12 which is of the same shape as the clamping sleeve is provided in the rotor body in order to support the clamping sleeve in the rotor body, the recesses 12 in the rotor body 5 and in the cutting blade 3 forming circle-segment cross sections which complement one another to form a circular cross section. The slotted clamping sleeve 11 can be pressed into this circular cross section, so that its cylindrical outer contour is connected in a force-fitting manner to the recesses in the axial direction, while in the radial direction a form-fitting connection is formed between cutting blade 3 and cutting rotor 1.

In this embodiment, the circle-segments of the cross sections of the recesses 12 in the rotor body 5 and the recesses 8 in the cutting blades 3 are radially offset with respect to one another. Since this offset only amounts to 0.02–0.2 millimetres, it is impossible to see in the outline sketch shown in FIG. 1. With this offset, the recess 8 in the cutting blade 3 is offset radially outwards with respect to the recess 12 in the rotor body 5. By means of this offset, the root region 22 of the cutting blade 3 is pressed onto the base of the groove 6 when the slotted clamping sleeve is driven into the clamped position. The arrangement of the recess 8 on the cutting-edge side 21 of the cutting blade 3 ensures that the clamping element 11 presses a rear side 25 of the cutting blade against the groove side wall 26 with surface-to-surface contact. In this way, the cutting forces which act on the projecting cutting edge 7 of the cutting blade 3 are advantageously transmitted to the rotor body 5 via the groove side wall 26.

Both the recess 12 in the rotor body 5 and the recess 8 in the cutting blade 3 have smooth surfaces and are easy to produce by milling or drilling. Thus, the clamping surfaces on which the clamping sleeve acts are completely free from thread-like notches, so that a material-weakening notching effect is avoided in particular in the area of the rotor body 5. Since the axial clamping brought about by the clamping sleeve does not exert any pressure whatsoever on the cutting blade 3 in the axial direction or in the longitudinal direction, the cutting blades are not bent or twisted in their longitudinal extent by the order of magnitude of the fit tolerance between groove 6 and cutting blade 3.

To exchange a cutting blade 3, the clamping sleeve 11 has to be removed from its clamping position. To this end, an internal screw thread may preferably be provided in the clamping sleeve.

FIG. 2 shows an outline sketch of a cutting rotor 1 of a pelletizing device in a second preferred embodiment of the invention. In this figure, identical reference numerals denote identical structural elements. In this preferred embodiment, the slotted clamping sleeve has an internal screw thread. This internal screw thread tapers conically inwards, so that a cylindrical grub screw 17 with a hexagon socket 27 on its clamping sleeve 11 can be screwed in and thus widens the cylindrical outer contour of the clamping sleeve, so that the latter connects the rotor body 5 to the cutting blade 3 in a form-fitting manner via the recesses 8 and 12 in the radial direction and, in a force-fitting manner, ensures that axial displacement of the cutting blades 3 with respect to the rotor body 5 is impossible. This second preferred embodiment of the invention, compared to the first, has the advantage that the clamping sleeve does not have to be pressed into the recesses 8 and 12, but rather can be slid in, and only connects the rotor body 5 and the cutting blades 3 in a force-fitting manner when the grub screw 17 is screwed into the internal screw thread, which tapers from the outside inwards, of the clamping sleeve 11.

FIG. 2 also shows a outline sketch of a cutting rotor 3 of a pelletizing device in a third preferred embodiment of the invention, which is now explained in detail with the aid of FIG. 3 to 6. To this end, FIG. 3 shows a view of a cutting blade 3 of a pelletizing device in the third embodiment of the invention. In the root area 22, this cutting blade 3 has two recesses 8 and 9 on the cutting-edge side 21, which recesses were made in the cutting blade 3 parallel to the cutting edge 7. This recess is clearly shown in profile in the side view shown in FIG. 4, and forms a segment of a circle in cross section. This segment of a circle is offset by 0.02 to 0.2 millimetres in the radially outward direction with respect to the recess 12 which is shown in FIGS. 1 and 2. This offset ensures that, during assembly and clamping by means of a clamping sleeve 11, the cutting blade 3 is pressed into the groove 6 in the rotor body 5 in the segmental direction, which is composed of a tangential component and a radial component.

FIG. 5 shows a cross section through a clamping sleeve 11 in a third embodiment of the invention. This clamping sleeve 11 has an internal screw thread 13 which extends cylindrically inwards from the outer edge 14 of the clamping sleeve and, in the end region 16 of the clamping sleeve, merges into an inner cone 15.

A grub screw 17, such as that illustrated in FIG. 6, is in engagement with the inner cone 15 by means of a conical extension 18 as soon as the grub screw 17 has been screwed into the internal screw thread 13 of the clamping sleeve 11. When the grub screw 17 is screwed into the clamping sleeve 11 in this way, the clamping sleeve 11 is widened, in the area of the inner cone 15, by the conical extension 18 of the grub screw 17. In the process, the transition from an external screw thread 28 of the grub screw 17 to the conical extension 18 is subjected only to compressive loads. The notching effect of the thread turns at the transition to the conical extension 18 is thus minimized, and even if a fracture were to occur at this point in the grub screw, the cutting blade 3 cannot become detached from the rotor body, since the clamping conical extension 18 cannot fly off, as is the case with a conical screw according to the prior art. Consequently, the grub screw 17 can be of considerably slimmer design, taking up less space, and the thread of the screw engages only in the internal screw thread in the sleeve, so that there is no need to provide a material-weakening threaded hole in the rotor body 5, as is necessary in the prior art.

To exchange the cutting blades, the clamping sleeve 11 can be quickly and securely exchanged by removing the grub screw and screwing in a withdrawal device. Due to the clear and calculable separation of functions between the grub screw and the clamping sleeve serving as the clamping element, the second and third embodiments in particular have considerably advantages and substantial security against the risk of fractures and incorrect performance compared to the solutions which are known from the prior art. Since the grub screw shown in FIG. 6, unlike a conical screw of the prior art, is not subjected to tensile loads, its dimensions can be kept extremely small, so that the recesses, in particular in the rotor body 5, can also be reduced in size compared to the prior art. This fact too increases the reliability of the pelletizing device according to the invention.

FIG. 7 shows a side view of a clamping element 10 with a device 30 for blocking rotation. In this preferred embodiment, this blocking device comprises an eccentric 29, which was formed onto the clamping sleeve 11 as a cylindrical extension. As shown in FIG. 4, the axis of the eccentric is in this case offset by half the depth t of the recess 9 in the cutting blade 3 with respect to the longitudinal axis 31 of the clamping sleeve 11. The eccentric is of a depth a. Accordingly, the recess 12 in the cutting rotor for holding the clamping element 10 according to FIG. 7 is deeper by the amount a than the recess 8 or 9 in the cutting blade 3. After the slotted clamping sleeve 11 as shown in FIG. 7 has been pushed into the recesses in the cutting rotor 1 and the cutting blade 3, the eccentric 29 is in engagement with that area of the cutting blade 3 which is free from recesses. The extension for blocking rotation of the clamping sleeve 11 may, as blocking device 30, be of any desired form if the recess 12 in the rotor body 5 is correspondingly adapted to the shape of the blocking device 30. Preferably, for this purpose, a recess, such as a hole, which is offset, adapted and enlarged so as to match the eccentric 29, may be arranged in the rotor body 5 as an extension of the recess 12.

FIG. 8 shows an enlarged portion of a cutting rotor 1 with fitted clamping element 10 and with a device 30 for blocking rotation of the clamping element 10, which is in the form of a clamping sleeve 11. The eccentric 29 lies below the plane of the drawing and is therefore shown in dashed lines. It can be seen clearly that the eccentric 29, due to its eccentric axis 33 being offset with respect to the longitudinal axis 34 of the clamping sleeve 11 by half the depth of the recess 9 in the cutting blade 3, is in engagement with the recess-free area 32 of the cutting blade 3 and thus prevents rotation of the clamping sleeve 11 when a grub screw as shown in FIGS. 2 and 6 is being screwed into and out of the internal screw thread 13 of the clamping sleeve 11.

What is claimed is:

1. Pelletizing device for cutting plastic fibre strands into pellets having a cutting rotor (1) which is rotated by a drive system and cutting blades (3) distributed over a circumference (2) of the rotor, root areas (22) of which blades are arranged in grooves (6) in the rotor body (5), each cutting blade (3) having at each end of a flat side extending to the cutting edge one recess (8, 9) parallel to the cutting edge (7), which recesses are covered by one of the grooves (6) to receive and interact with clamping elements (10) being held in an opposite recess (12) in the rotor body, wherein each clamping element (10) is a slotted clamping sleeve (11) having a cylindrical outer contour which fits within one of the recesses (8, 9) in the cutting blade and one of the opposite recesses (12) each having the same shape as the clamping sleeve, each clamping sleeve (11) having an internal screw thread (13) which extends inwards from the outer edge (14) of the clamping sleeve (11) and merges into a smooth inwardly tapering inner cone (15) in the end region (16) of the clamping sleeve (11), wherein the inner cone (15) of the clamping sleeve (11), by the insertion of a grub screw (17), can be brought into engagement with an attached cone (18), the grub screw (18) in the area of the inner cone (15) of the slotted clamping sleeve (11), widens the latter in the segmental direction with respect to the cutting rotor, towards the recess (8, 9) in the cutting blade (3), so that when the grub screw (17) has been screwed in, the cutting blade (3) is connected to the rotor body (5) in a form-fitting and force-fitting manner by means of the clamping sleeve (11).

2. Pelletizing device according to claim 1, wherein each opposite recess (12) in the rotor body corresponds to one recess (8,9) in one of the cutting blades (3), which recesses, in cross section, form segments of a circle which are offset with respect to one another.

3. Pelletizing device according to claim 2, wherein that the circle-segment cross section of each recess (8, 9) in the cutting blade (3) is offset radially outwards with respect to the circle-segment cross section of the opposite recess (12) in the rotor body (5).

4. Pelletizing device according to claim 1 wherein each of the clamping sleeves is made from spring steel.

5. Pelletizing device according to claim 1 wherein an eccentric extension (29) is arranged on the inner end of the clamping sleeve (11).

6. Pelletizing device according to claim 1 wherein the clamping sleeve (11) is made from spring bronze.

7. Pelletizing device according to claim 1 wherein the cutting blades (3), with their root area (22) in the grooves (6), are arranged in the rotor body (5) with a uniform distribution on the rotor circumference (2), at an acute angle, in the axial direction, of less than 10 degrees with respect to the rotor axis (4) of the cutting rotor (1).

8. Pelletizing device according to claim 1 wherein the recess (8, 9) in the cutting blade (3) is formed on the cutting-edge side (21).

* * * * *